US007810861B1

(12) United States Patent
Heinrichs

(10) Patent No.: US 7,810,861 B1
(45) Date of Patent: Oct. 12, 2010

(54) HOISTING DEVICE, TRANSPORTING SYSTEM, AND METHODS

(75) Inventor: Mark Heinrichs, Brielle, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 435 days.

(21) Appl. No.: 11/973,983

(22) Filed: Sep. 28, 2007

(51) Int. Cl.
*B66C 1/66* (2006.01)

(52) U.S. Cl. ..... 294/67.4; 294/74

(58) Field of Classification Search ..... 294/67.1, 294/67.3, 67.4, 67.41, 74, 81.55, 68.3; 108/11, 108/51.11
See application file for complete search history.

(56) References Cited

U.S. PATENT DOCUMENTS

| | | | | | |
|---|---|---|---|---|---|
| 2,459,207 | A | * | 1/1949 | Worthington | 294/67.4 |
| 2,595,182 | A | | 4/1952 | Weingarten | |
| 2,721,757 | A | | 10/1955 | Anderson | |
| 2,974,994 | A | * | 3/1961 | Goldsmith | 294/67.1 |
| 3,065,987 | A | * | 11/1962 | Elsner et al. | 294/67.4 |
| 3,239,265 | A | * | 3/1966 | Scibilia | 294/67.4 |
| 3,424,488 | A | | 1/1969 | Renfore | |
| 3,905,632 | A | | 9/1975 | Caylor et al. | |
| 4,252,358 | A | | 2/1981 | Klebs | |
| 4,550,940 | A | * | 11/1985 | Schweikert | 294/67.4 |
| 4,736,975 | A | * | 4/1988 | Perez et al. | 294/81.55 |
| 4,826,228 | A | | 5/1989 | Dinitz et al. | |
| 4,869,540 | A | | 9/1989 | Faul | |
| 4,925,226 | A | * | 5/1990 | Leonard et al. | 294/82.1 |
| 5,052,735 | A | | 10/1991 | Kuse | |
| 5,346,270 | A | | 9/1994 | Kuse | |
| 5,473,908 | A | | 12/1995 | Saia, III et al. | |
| 6,305,728 | B1 | | 10/2001 | Holter et al. | |
| 6,565,136 | B1 | | 5/2003 | Parker | |
| 6,991,274 | B2 | | 1/2006 | Brooks | |
| 7,156,249 | B2 | | 1/2007 | Heinrichs | |
| 7,178,846 | B2 | | 2/2007 | Niskanen | |

OTHER PUBLICATIONS

U.S. Appl. No. 11/387,081, filed Mar. 20, 2006, Heinrichs, et al.
U.S. Appl. No. 11/387,082, filed Mar. 20, 2006, Heinrichs, et al.
U.S. Appl. No. 11/387,084, filed Mar. 20, 2006, Heinrichs, et al.

* cited by examiner

*Primary Examiner*—Dean J Kramer
(74) *Attorney, Agent, or Firm*—Fredric Zimmerman

(57) ABSTRACT

A hoisting device includes a sling and first and second fork-pocket adaptors interconnected to the sling for engaging first and second fork pocket sets on opposite sides of a palletized structure. The first fork-pocket adaptor includes a first locking mechanism for mating with a corresponding locking feature of the first fork pocket set. In an exemplary embodiment, the first locking mechanism includes a retractable first engagement member at one end of the first fork-pocket adaptor for engaging a corresponding first locking feature of the first fork pocket set. The opposite end of the first fork-pocket adaptor includes a second locking mechanism with a second engagement member for engaging a corresponding second locking feature of the first fork pocket set.

17 Claims, 4 Drawing Sheets

HOISTING DEVICE, TRANSPORTING SYSTEM, AND METHODS

GOVERNMENT LICENSING CLAUSE

The invention described herein may be manufactured and used by or for the Government of the United States of America for governmental purposes without the payment of any royalties thereon or therefore.

FIELD OF THE INVENTION

The present invention relates to a load lifting device, and in particular an overhead lifting device especially suitable for engagement with palletized loads generally useful in the storage and transportation of goods, especially palletized loads, capable of being loaded onto and off-loaded unloadable from vehicles such as flat-bed trucks, ships, and cargo bays.

BACKGROUND OF THE INVENTION

Pallets are widely used in the shipping industry for facilitating efficient and expeditious movement of goods (e.g., inventory, products, parts, commodities, etc.) from one place to another, and for the storage of goods prior or subsequent to shipment. Generally, pallets typically comprise a base on which parallel spaced planks rest to form a platform surface. The base usually comprises boards arranged relative to one another or shaped to contain fork pockets. To move goods set on the platform surface, fork tines of a forklift are inserted horizontally into the fork pockets, then raised to lift the pallet and load off the ground. The forklift is then driven or moved for either re-locating the goods to a desired location or loading or unloading the loaded pallet on to or off of a vehicle, such as a truck, ship, or aircraft, for transportation to their intended destination.

While pallets and their loads usually can be moved relatively easily and safely using a forklift, most pallets are not designed for overhead hoisting, such as with a crane. One possible solution is to hoist a pallet from above using cables suspended from a crane and mated with grommets at the corners of the pallet. Another solution is to pass the cables under the pallet so as to cradle the pallet. These solutions lack adequate locking dependability, are laborious and time-consuming to implement, and may raise safety concerns if not implemented by properly trained personnel.

SUMMARY OF THE INVENTION

In accordance with the purposes of the invention as embodied and broadly described herein, a first aspect of the invention provides a hoisting device, featuring a sling and first and second fork-pocket adaptors interconnected to the sling for respectively engaging first and second fork pocket sets on opposite sides of a palletized structure. The first fork-pocket adaptor has a first locking mechanism for mating with a corresponding locking feature of the first fork pocket set.

A second aspect of the invention resides in a transporting system, featuring a palletized structure having first and second fork pocket sets on opposite sides of the palletized structure, the first pocket set having a first locking feature. The transporting system further features a hoisting device including a sling and first and second fork-pocket adaptors interconnected to the sling for respectively engaging the first and second fork pocket sets. The first fork-pocket adaptor has a first locking mechanism for mating with the first locking feature.

According to a third aspect of the invention, a transporting system is provided, featuring a rigid base structure and a hoisting device. The rigid base structure includes first and second recesses on opposite sides thereof, the first recess having first and second receptacles, and second recess having third and fourth receptacles. The hoisting device includes a sling and first and second adaptors interconnected to the sling for respectively engaging the first and second recesses, respectively. The first adaptor has first and second locking mechanisms at opposite end portions thereof for mating with the first and second receptacles, respectively. The second adaptor has third and fourth locking mechanisms at opposite end portions thereof for mating with the third and fourth receptacles, respectively.

A fourth aspect of the invention provides a method of preparing a palletized structure for transport. The method features providing a hoisting device including a sling and first and second fork-pocket adaptors interconnected to the sling, the first fork-pocket adaptor including a first locking mechanism. The first and second fork-pocket adaptors are respectively engageable with first and second fork pocket sets on opposite sides of a palletized structure. When engaged, the first locking mechanism is mated with a corresponding locking feature of the first fork pocket set.

According to a fifth aspect of the invention, a method is provided for preparing a rigid base structure for transport. The method includes providing a hoisting device including a sling and first and second adaptors interconnected to the sling. The first adaptor includes first and second locking mechanisms at opposite end portions thereof, and the second adaptor includes third and fourth locking mechanisms at opposite end portions thereof. The first and second adaptors are respectively engaged with first and second recesses on opposite sides of the rigid base structure. The first and second locking mechanisms are respectively mated with first and second receptacles of the first recess, and the third and fourth locking mechanisms are respectively mated with third and fourth receptacles of the second recess.

Other aspects of the invention involve methods of making and using the hoisting devices and transporting systems described herein.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS OF THE INVENTION

Figure 1:
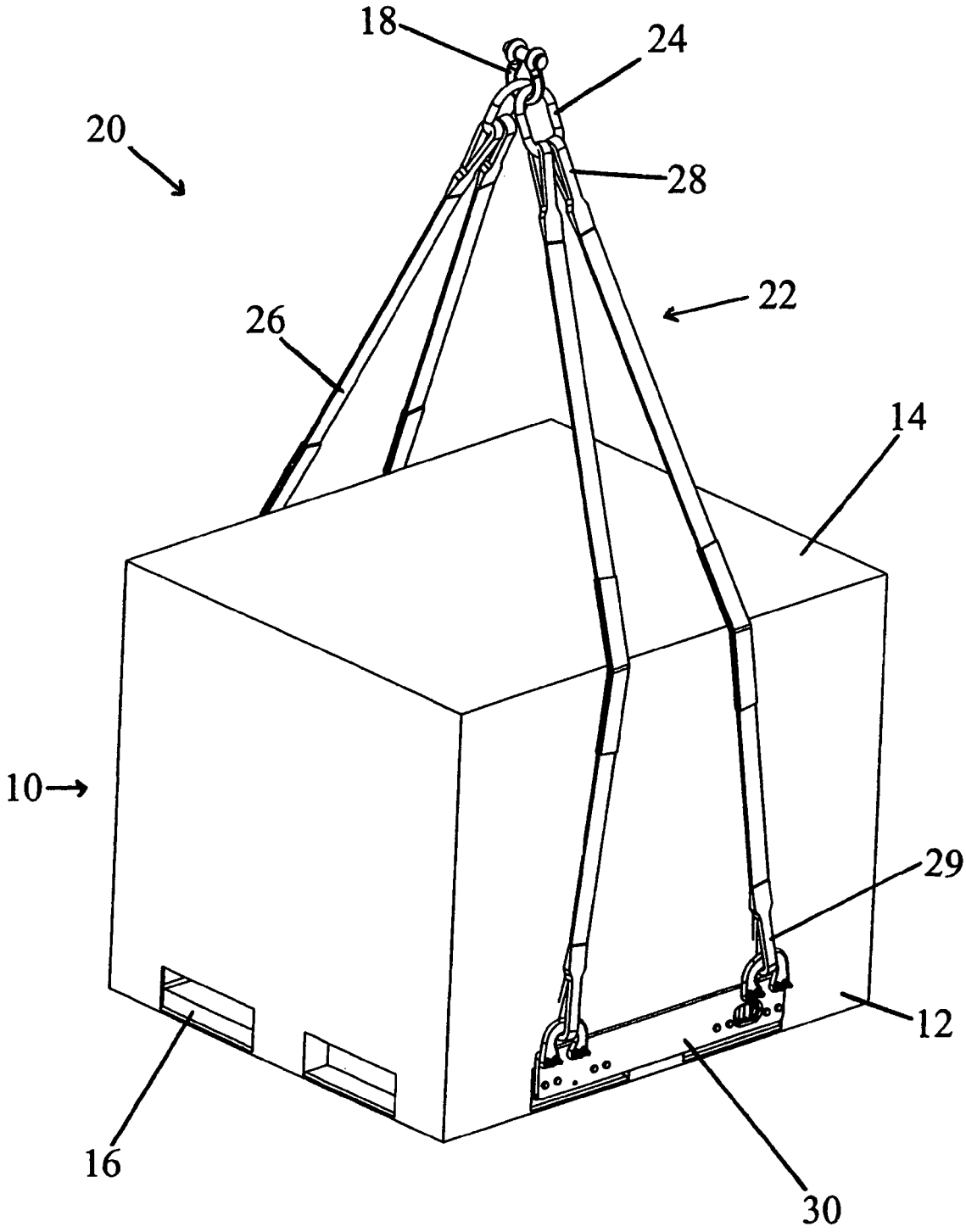
FIG. 1 is a perspective view of a transporting system according to a first embodiment of the invention, the transporting system including a hoisting device and a rigid base structure in the form of a palletized structure integrated with a container.

Reference will now be made in detail to the exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the exemplary embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

The terms "left," "right," "front," "rear" and the like are used herein to assist in and facilitate the description of the invention and its principles and advantages. For the purposes of the detailed description, the reference for each of these terms is the arrangement and orientation of the pallet as it is depicted in FIG. 1, in which the pallet platform is horizontally oriented and the front frame member faces forward. The ability to move and rotate the pallet into other orientations and positions makes the designations of these terms to the various parts of the pallet dependent upon view of reference.

According to an embodiment of the invention, the hoisting device includes a sling and first and second adaptors interconnected to the sling for respectively engaging first and second recesses, and, in particular, fork pocket sets, on opposite sides of a rigid support structure. The first adaptor has a first locking mechanism for mating with a corresponding locking feature of the first recess.

Referring to the embodiment depicted in FIG. 1, the load is generally designated by reference numeral 10, and as shown includes a rigid support structure in the form of a pallet 12 with a container 14 integrated thereon. Various palletized systems are suitable for the present invention, for example, and without limitation, the palletized system disclosed in U.S. Pat. No. 7,156,249. These pallets systems include, by way of example, pallets, containers, collapsible containers, and storage rack systems. Modification of these palletized systems make them compatible with embodiments of the present invention within the purview of a person skilled in the art having reference to the description provided herein.

Figure 2:
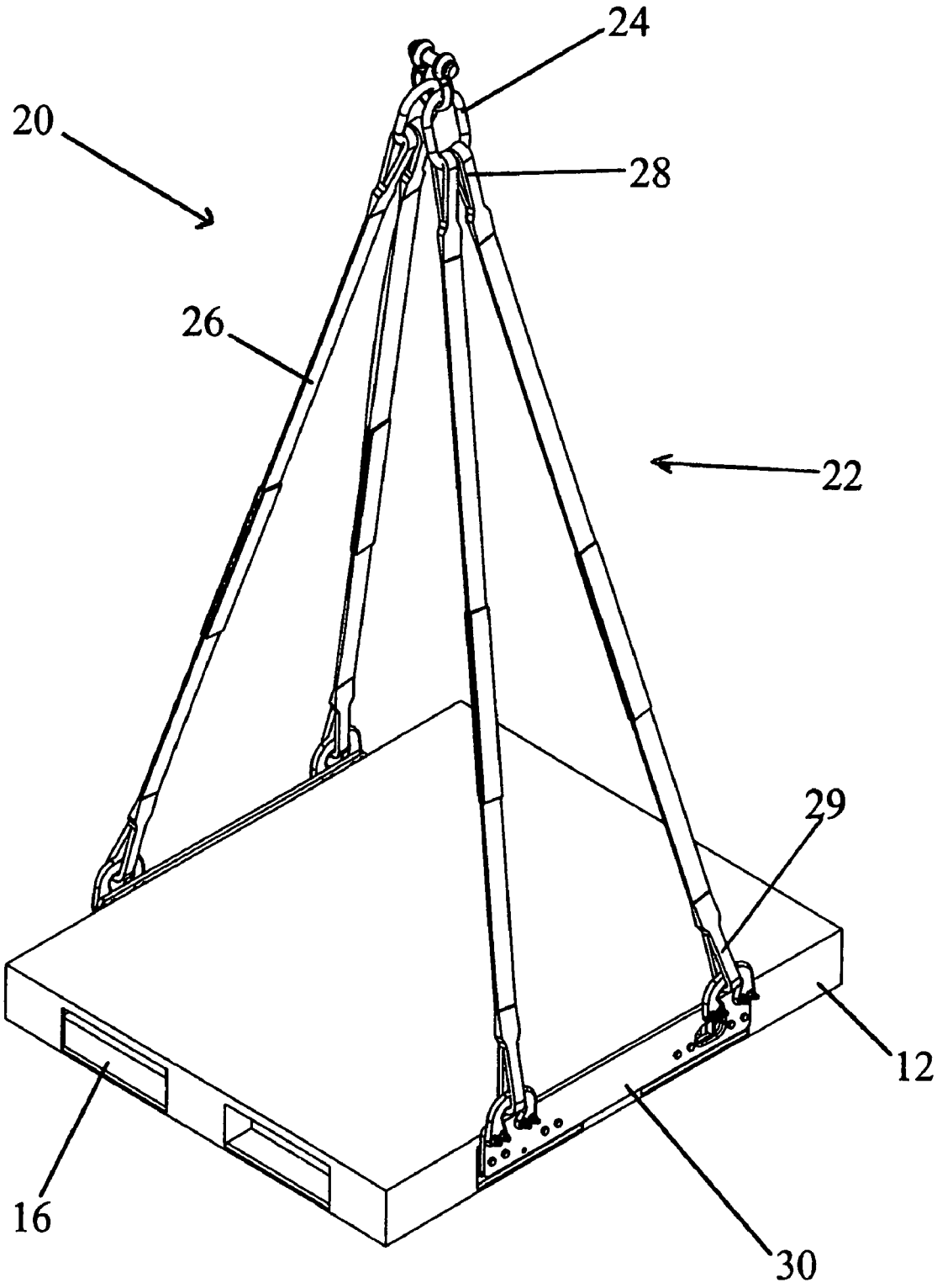
FIG. 2 is a perspective view of a transporting system according to a second embodiment of the invention, the transporting system including the hoisting device of FIG. 1 and a rigid base structure in the form of a pallet.

Pallet 12 features a pallet frame supporting a pallet platform. Pallet frames are usually quadrilateral, and, in exemplary embodiments, are rectangular or square. As best shown in FIG. 2, the pallet frame outer edge comprises four elongate beams. Each beam includes entryway openings or fork pockets 16 arranged side by side in a set. Fork pockets 16 are sized and positioned to receive forklift tines from either side or either end of pallet 12. It should be understood that the frame of pallet 12 may be provided with a different number of fork pockets 16, e.g., one or more of the elongate beams of the pallet frame may omit fork pockets 16. Also, a fork pocket set may include more than two openings 16, or only a single opening 16.

A pallet platform is positioned on and supported by the pallet frame. The pallet frame and pallet platform may be made of the same or different materials, such as, for example, wood, metal, composite, or other suitable materials. The pallet platform has substantially flat upper and lower surfaces, and may comprise, for example, a solid integral sheet or a plurality of parallel planks. Alternatively, the pallet platform may include a mesh, grating or the like.

The hoisting device of FIG. 1 is generally designated by reference numeral 20. Hoisting device 20 includes a sling generally designated by reference numeral 22 in FIGS. 1 and 2. Sling 22 includes couplers 24 for engaging a counterpart coupling part of a crane or the like capable of imparting vertical movement to sling 22. Couplers 24 are provided with a ring shape in the illustrated embodiment for mating with a crane hook or fastener 18. It should be understood that couplers 24 may take other forms, and may be integrated into a single piece.

Sling 22 may include a plurality of suspension members 26 extending downward from couplers 24. In FIGS. 1 and 2, suspension members 26 are illustrated as flexible straps each having a loop 28 at its upper end for engaging couplers 24, and a loop 29 at its lower end. It should be understood that the illustrated straps may be replaced or supplemented with alternative flexible members, such as rope, cable, chains, harnesses, belts, and the like. It should further be understood that the illustrated strap may be replaced with a more rigid or less flexible structure, such as grapple arms, frames, and similar structures. It is possible to make suspension members 26 adjustable in length for accommodating different size loads. The loops at the opposite ends of suspension member 26 may be replaced with, for example, hooks, clips, etc. Although not shown, sling 22 may comprise other components, such as crossbars and spreaders.

Figure 3:
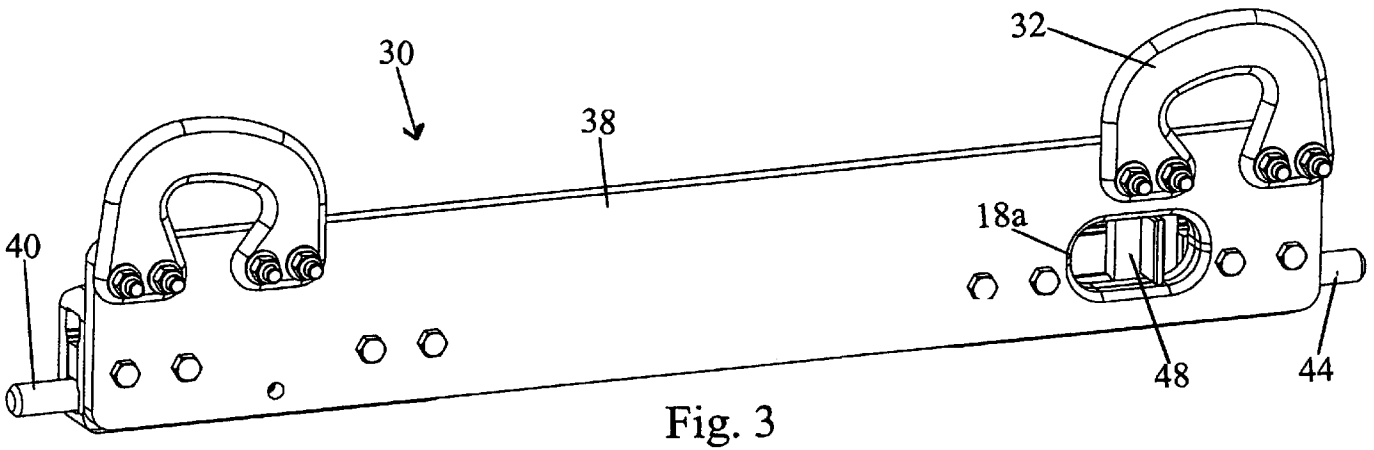
FIG. 3 is a perspective front view of an adaptor of the hoisting device of FIGS. 1 and 2, in which the adaptor is isolated from the rigid base structure and the remainder of the hoisting device.
Figure 4:
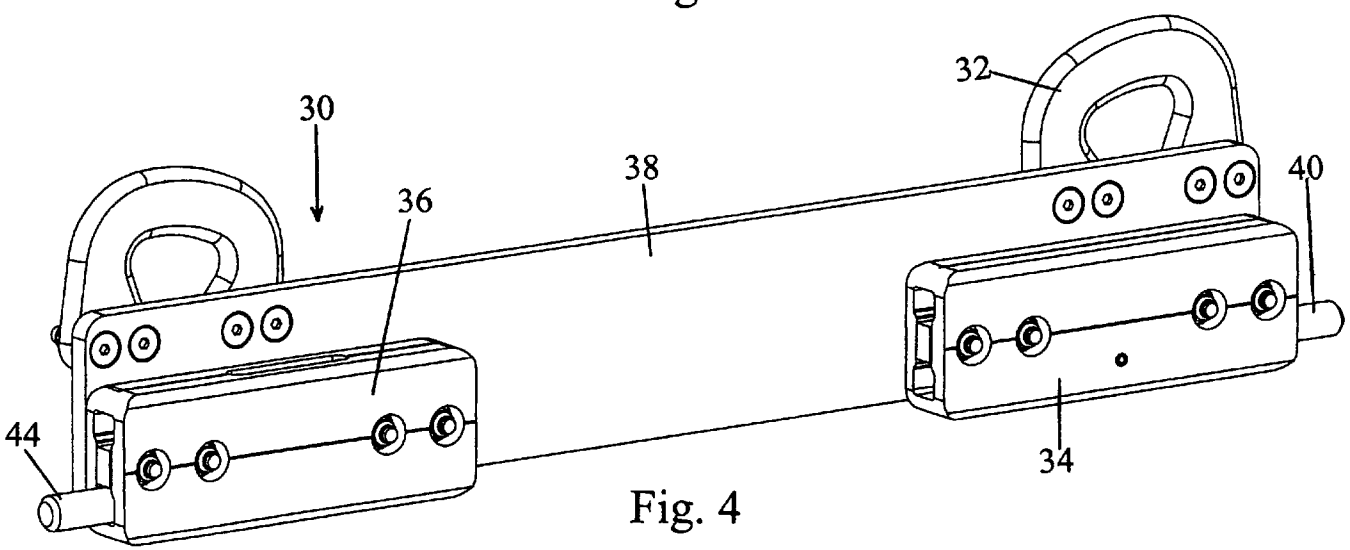
FIG. 4 is a perspective rear view of an adaptor of the hoisting device of FIGS. 1 and 2, in which the adaptor is isolated from the rigid base structure and the remainder of the hoisting device.
Figure 5:
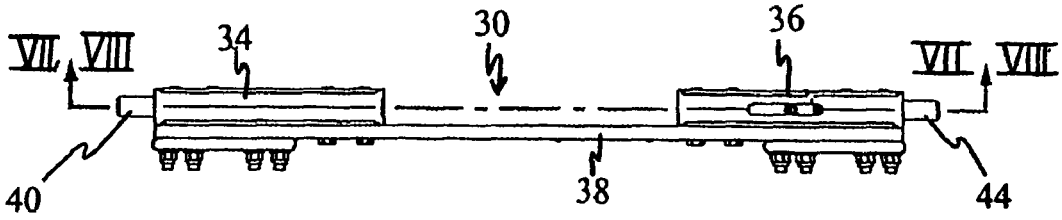
FIG. 5 is an overhead view of the adaptor of FIG. 3.
Figure 6:
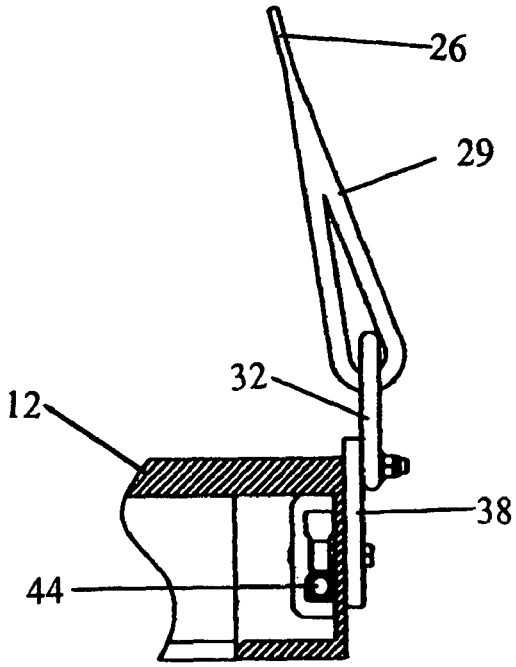
FIG. 6 is a cross-sectional side view of the pallet of FIG. 2 having its fork tine opening mated with the adaptor.

Hoisting device 20 further includes first and second fork-pocket adaptors 30 interconnected to sling 22 for respectively engaging first and second fork pocket sets 16 on opposite sides of pallet 12. By interconnected, it is meant that adaptors 30 may be directly or indirectly (via one or more intervening components) connected to sling 22. As best shown in FIGS. 3 and 4, each adaptor 30 includes a pair of handles 32 for coupling with looped lower ends 29, which having extending through handles 32. It should be understood that looped lower ends 29 and/or handles 32 may be replaced with alternative or supplemental coupling elements.

Adaptors 30 each include a main body 38 configured as an elongate plate. Elongate plate 38 includes an access opening 18*a* (FIG. 3), the purpose of which will be described in greater detail below. Adaptors 30 each include a first locking mechanism 34 mounted to one end portion of elongate plate 38 of adaptor 30 and a second locking mechanism 36 mounted to the opposite end portion of elongate plate 38 of adaptor 30.

Figure 7:
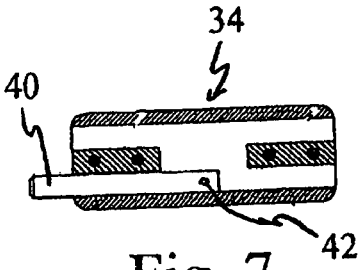
FIG. 7 is a sectional side view taken along sectional line VIII-VII of FIG. 5 of a stationary locking mechanism of the adaptor of FIG. 3.

As best shown in FIG. 7, first locking mechanism 34 includes a stationary member 40 in a form, in an exemplary embodiment, of an engagement pin. A concealed portion of stationary member 40 is received in the housing of first locking mechanism 34. The remaining portion of stationary member 40 protrudes from the housing beyond a respective end of elongate plate 38 for mating with a corresponding locking feature of pallet 12. A fastener 42, such as a rivet, bolt, screw, etc, retains stationary member 40 in a fixed position so that the portion of stationary member 40 not received in the housing of first locking mechanism 34 permanently extends beyond the end of elongate plate 38.

Figure 8:
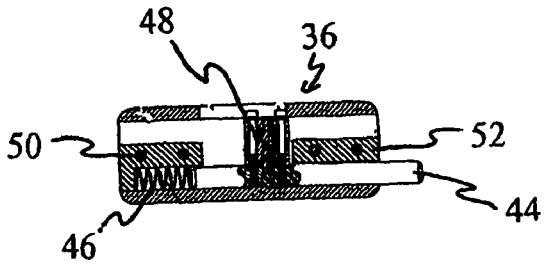
FIG. 8 is a sectional side view taken along sectional line VIII-VIII of FIG. 5 of the retractable locking mechanism of the adaptor of FIG. 3.

As best shown in FIG. 8, second locking mechanism 36 includes a retractable member 44 also in the form of an engagement pin. It should be understood that the engagement pins defining stationary member 40 and retractable member 44 may be replaced with alternative components capable of mating with pallet 12. A concealed portion of retractable member 44 is received in the housing of second locking mechanism 36, and the remaining portion of retractable member 44 protrudes from the housing of second locking mechanism 36 and extends beyond a respective end of elongate plate 38. Second locking mechanism 36 further includes a biasing member 46 abutting an end of retractable member 44 for urging retractable member 44 outward to extend beyond the respective end of elongate plate 38, as shown in FIG. 8. In FIG. 8, biasing member 46 is represented by a compression spring. An activator 48 is situated in the housing of second locking mechanism 36 in a channel (unnumbered) between bosses 50 and 52. Activator 48 is operatively secured to retractable member 44 using a fastener, e.g., a pair of bolts in FIG. 8, or by integrally forming activator 48 with retractable member 44.

In its default position, the bias of spring 46 urges retractable member 44 outward so as to contact activator 48 with boss 52. In this default position, a portion of retractable member 44 protrudes outside of its housing and beyond the side edge of elongate plate 38 for mating with a corresponding locking feature of pallet 12. Access opening 18*a* provided in plate 38 permits a user, in particular the user's finger or an instrument, to access and slide activator 48. The user accessing activator may apply a force sufficient to overcome the urging bias of spring 46 and thereby slide activator 48 towards boss 50. The sliding movement of activator 48 into contact with boss 50 causes retractable member 44 to retract, fully, into the housing of second locking mechanism 36 so that retractable member 44 does not protrude beyond the side edge of elongate plate 38. In this manner, retractable member 44 may be disengaged from mating relationship with the corresponding locking feature of pallet 12.

The corresponding mating features of pallet 12 for receiving members 40 and 44, in an exemplary embodiment, include receptacles, such as holes shaped and sized to receive the engagement pins, formed in pallet 12 at the opposite ends of fork pocket set 16.

It should be understood that the invention encompasses many variations and modifications to the illustrated embodiment. For example, both locking mechanisms 34 and 36 may possess retractable engagement members. Further, while the opposite ends of the adaptors have been described as the opposite adaptor sides, the term opposite ends may also encompass the top and bottom of the adaptor. As yet another example of a modification, the biasing member may be omitted from the locking mechanisms. These described variations and modifications are merely illustrative and not exhaustive of the breadth of the invention.

To mate hoisting device 20 with pallet 12, the user juxtaposes adaptors 30 with respective fork pocket sets 16 of pallet 12. Adaptors 30, in an exemplary embodiment, are substantially equal in length and receivable within their respective fork pockets 12. For each adaptor, stationary member 40 of first locking mechanism 34 is placed into a corresponding receptacle at one end of a fork pocket set 16. Activator 48 is slid by a user to displace retractable member 44 towards boss 50 and slide retractable member 44 into the housing of second locking mechanism 36. Retractable member 44 is aligned with a corresponding receptacle at the other end of fork pocket set 16, and activator 48 is released by the user to allow biasing member 46 to urge retractable member 44 into the receptacle of pallet 12. This mating procedure is repeated on opposite side of pallet 12 for mating the other adaptor with a fork pocket set on the opposite side of pallet 12.

Suspension members 26 are secured to handles 32 at their lower ends and couplers 24 at their opposite ends. Optionally, the length of suspension members 26 is adjusted. Couplers 24 are mated with a crane or other lifting apparatus for raising and lowering load 10. Optionally, suspension members 26 may be secured to handles 32 and couplers 24 prior to mating adaptors 30 with pallet 12.

Assemblage of hoisting device 20 may be performed in any suitable sequence. Generally, first and second locking mechanisms 34 and 36 are mounted on elongate plate 38 so that protruding portions of stationary member 40 and retractable member 44 extend beyond the opposite ends of plate 38. Handles 32 are mounted on elongate plate 38. Suspension members 26 are joined to handles 32 at their lower ends and coupler 24 at their upper ends.

Advantageously, hoisting device 20 may be efficiently mated with a pallet 12 or other rigid structure to provide a safe and reliable transportation system. Further, modification to pallet 12 to cooperate with hoisting device 20 is minimal, generally involving the mounting or creation of locking features, e.g., receptacles, on or in pallet 12. Hoisting device 20 may be operated safely and effectively with minimal training.

Additional advantages and modifications will readily occur to those skilled in the art. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

Finally, the numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A hoisting device, comprising:

a sling; and a first fork-pocket adaptor and a second fork-pocket adaptor being interconnected to the sling for respectively engaging a first pocket set and a second fork pocket set on opposite sides of a palletized structure, wherein the first fork-pocket adaptor comprises a first locking mechanism to mate with a first locking feature of the first fork pocket set, wherein the first fork-pocket adaptor further comprises a second locking mechanism to mate with a second locking feature of the first fork pocket set, and wherein at least one of the first locking mechanism and the second locking mechanism comprises a retractable engagement member.

2. The hoisting device of claim 1, wherein said sling further comprises a coupler engageable by a crane to impart vertical movement to the sling, and a plurality of suspension members extend to opposite ends of the first fork pocket adaptor and a second fork-pocket adaptor.

3. The hoisting device of claim 1, wherein the first locking mechanism comprises a retractable engagement member.

4. The hoisting device of claim 3, wherein the retractable engagement member comprises an engagement pin.

5. The hoisting device of claim 3, wherein the first locking mechanism further comprises a biasing member to urge the retractable engagement member into a position of engagement with the first locking feature of the first fork pocket set.

6. The hoisting device of claim 3, wherein the first fork-pocket adapter further comprises a second locking mechanism, which comprises a stationary engagement member, and wherein the retractable engagement member and the stationary engagement member are located at opposite ends of the first fork-pocket adaptor.

7. The hoisting device of claim 1, wherein the first locking mechanism and the second locking mechanism are positioned at opposite end portions of the first fork-pocket adaptor.

8. The hoisting device of claim 1, wherein the second fork-pocket adaptor comprises locking mechanisms to mate with corresponding locking features of the second fork pocket set, and wherein at least one of the locking mechanisms of the second fork-pocket adaptor comprises a retractable engagement member.

9. A transporting system, comprising:

a palletized structure comprising a first fork pocket set and a second fork pocket set on opposite sides thereof, wherein the first pocket set comprises a first locking feature, and a hoisting device comprising a sling, a first fork-pocket adaptor, and a second fork-pocket adaptor, wherein the first fork-pocket adaptor and the second fork-pocket adaptor are interconnected to the sling to engage, respectively, the first fork pocket set and the second fork pocket set, wherein the first fork-pocket adaptor comprises a first locking mechanism to mate with the first locking feature, wherein the first fork-pocket adaptor further comprises a second locking mechanism to mate with a second locking feature of the first fork pocket set, and wherein at least one of the first locking mechanism and the second locking mechanism comprises a retractable engagement member.

10. The transporting system of claim 9, wherein said sling further comprises a coupler engageable by a crane to impart vertical movement to the sling, and a plurality of suspension members extend to opposite ends of the first fork-pocket adaptor and the second fork-pocket adaptor.

11. The transporting system of claim 9, wherein the first locking mechanism comprises a retractable engagement member.

12. The transporting system of claim 11, wherein the retractable engagement member comprises an engagement pin.

13. The transporting system of claim 11, wherein the first locking mechanism further comprises a biasing member to urge the retractable engagement member into a position of engagement with the first locking feature of the first fork pocket set.

14. The transporting system of claim 11, wherein the first fork-pocket adapter further comprises a second locking mechanism, which comprises a stationary engagement member, and wherein the retractable engagement member and the stationary engagement member are located at opposite ends of the first fork-pocket adaptor.

15. The transporting system of claim 9, wherein the first locking mechanism and the second locking mechanism are positioned at opposite end portions of the first fork-pocket adaptor.

16. The transporting system of claim 9, wherein the second fork-pocket adaptor comprises locking mechanisms to mate with corresponding locking features of the second fork pocket, and wherein at least one of the locking mechanisms of the second fork-pocket adaptor comprises a retractable engagement member.

17. A transporting system, comprising:

a rigid base structure comprising a first recess and a second recess on opposite sides thereof, the first recess comprises a first receptacle and a second receptacle, and the second recess comprises a third receptacle and a fourth receptacle; and a hoisting device comprising a sling, a first adaptor, and a second adaptor, the first adaptor and the second adaptor are interconnected to the sling to engage, respectively, the first recess and the second recess, respectively, wherein the first adaptor comprises a first locking mechanism and a second locking mechanism at opposite end portions thereof to mate with the first receptacle and the second receptacle, respectively, and wherein the second adaptor comprises a third locking mechanism and a fourth locking mechanism at opposite end portions thereof to mate with the third receptacle and the fourth receptacles, respectively.

* * * * *